US005211470A

United States Patent [19]

Frost et al.

[11] Patent Number: 5,211,470

[45] Date of Patent: * May 18, 1993

[54] SELF-CONTAINED SOLAR POWERED LIGHT

[75] Inventors: John S. Frost, Thousand Oaks; Mark R. Erickson, Oxnard; Kimberly E. Seegan, Agoura Hills; Brent P. Boyer, Moorpark, all of Calif.

[73] Assignee: Siemens Solar Industries, L.P., Camarillo, Calif.

[ * ] Notice: The portion of the term of this patent subsequent to Nov. 12, 2008 has been disclaimed.

[21] Appl. No.: 779,417

[22] Filed: Oct. 17, 1991

Related U.S. Application Data

[62] Division of Ser. No. 392,508, Aug. 11, 1989, Pat. No. 5,065,291.

[51] Int. Cl.[5] ..... F21L 7/00

[52] U.S. Cl. ..... 362/183; 362/31; 362/800

[58] Field of Search ..... 362/183, 31, 32, 800, 362/431; 136/281

[56] References Cited

U.S. PATENT DOCUMENTS

| | | | |
|---|---|---|---|
| 4,751,622 | 6/1988 | Williams | 362/183 |
| 4,835,664 | 5/1989 | Wen | 362/183 |
| 4,843,525 | 6/1989 | Williams | 362/183 |
| 5,041,952 | 8/1991 | Janda et al. | 362/183 |
| 5,055,984 | 10/1991 | Hung et al. | 362/183 |
| 5,065,291 | 11/1991 | Frost et al. | 362/183 |

*Primary Examiner*—Richard R. Cole

*Attorney, Agent, or Firm*—Nilsson, Wurst and Green

[57] ABSTRACT

A self-contained solar powered marking light. The marking light may be utilized to delineate certain predetermined boundaries without effectively illuminating the areas. The marking light automatically illuminates when output power from the photovoltaic cells contained therein fall below a predetermined level and automatically extinguishes when the voltage from the photovoltaic cells reaches a predetermined level. The marking light includes a lens which is closely coupled to a source of light and which includes a textured surface for diffusing the light to cause the lens to appear to glow when the source of light is illuminated. An electrical circuit is coupled between the photovoltaic cells and a battery and includes the source of light and switching means for automatically illuminating the light dependent upon the relative relationship between the voltage of the photovoltaic cells and the battery voltage.

8 Claims, 2 Drawing Sheets

SELF-CONTAINED SOLAR POWERED LIGHT

This application is a division of Ser. No. 07/392,508 filed Aug. 11, 1989 and now U.S. Pat. No. 5,065,291.

BACKGROUND OF THE INVENTION

This invention relates generally to lighting devices and more particularly to a self-contained photovoltaic powered low light level marking light.

In the prior art, there exists many electrically powered outdoor low voltage lights which are utilized to mark and illuminate pathways, yards, certain areas of parks and other predetermined areas. Typically, these lights are interconnected to the public utility source of electric power and are controlled by preset timing devices so that they illuminate at night fall and extinguish at a predetermined time such as approaching daybreak or the like. Such lights require extensive cabling including conduits along with appropriate timing mechanisms and thus are relatively expensive to install and maintain.

In many instances, there is no particular need to illuminate a particular area but rather only a need to delineate the area. There is further a need to provide a source of illumination for such delineation which does not require interconnection to a public utility source of power or the like and which is relatively easy and inexpensive to install and requires no maintenance.

SUMMARY OF THE INVENTION

A marking light having a low voltage light source coupled to a self contained electrical power source for automatically providing electrical power to illuminate said light source when ambient light falls below a predetermined level. A lens is closely coupled to the light source for diffusing light emanating therefrom.

DETAILED DESCRIPTION

Figure 1:
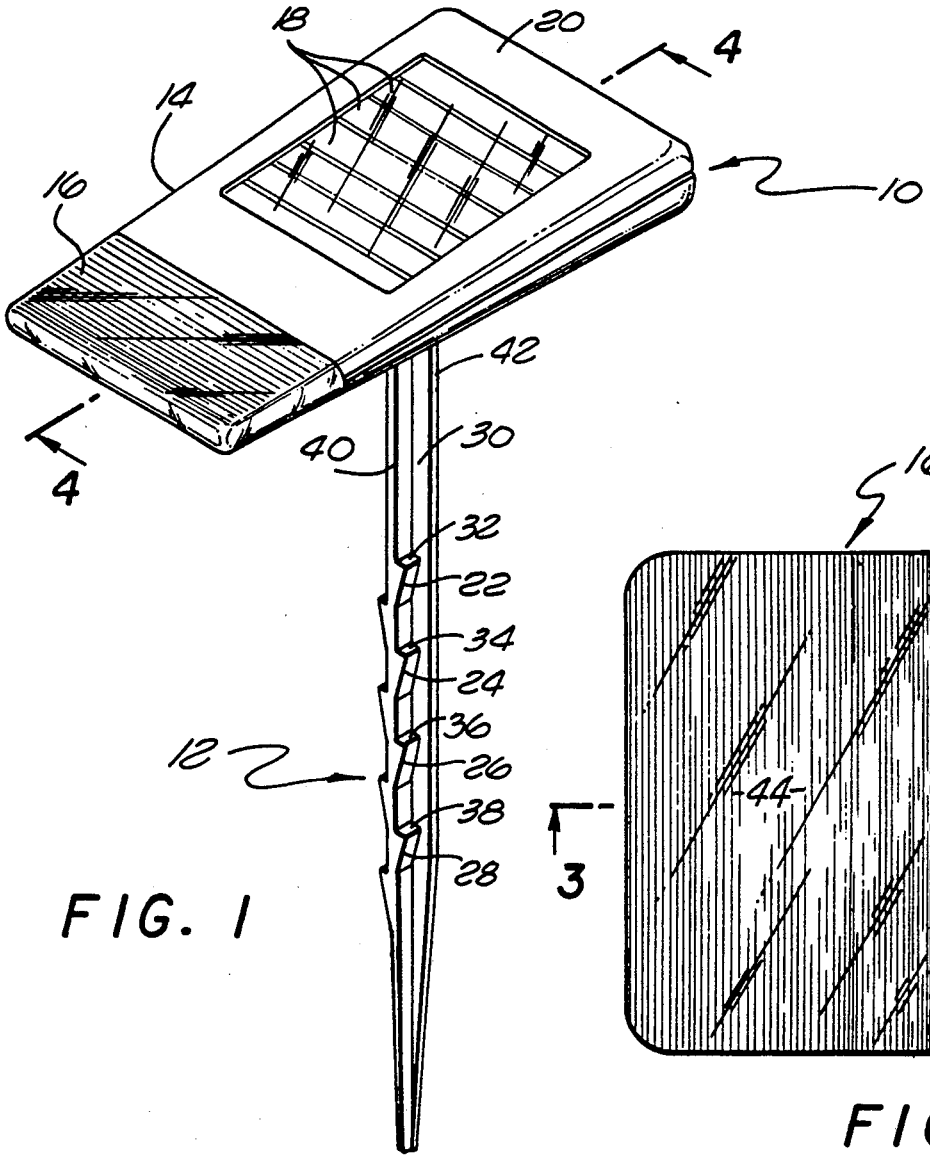
FIG. 1 is a prospective view illustrative of a marking light constructed in accordance with the principals of the present invention.

Referring now more particularly to FIG. 1, there is illustrated a marking light 10 constructed in accordance with the principles of the present invention. As is shown, the marking light 10 is a totally self-contained unit which is supportable upon a stake 12 and includes a housing 14 having a lens 16. A series of photovoltaic cells 18 are disposed in the upper surface 20 of the light 10 so as to be generally exposed to the sunlight when the light 10 is placed in its operational position. It will be recognized by those skilled in the art that a plurality of the marking lights 10 may be disposed in any predetermined arrangement as desired by pressing the stake 12 into the earth so as to position the lens 16 of the light at a particular desired delineation or demarkation position. By thus positioning a plurality of the marking lights 10, a particular area, such as a pathway, may be easily delineated so that a person, even in complete darkness, may be able to follow the pathway without the necessity of producing sufficient illumination to illuminate the pathway.

The only source of power for the marking light 10 constitutes a battery (described more in detail hereinbelow) which is maintained in a charged condition by the sunlight striking the photovoltaic cells 18 during the daytime. When the output voltage from the photovoltaic cells 18 reaches a predetermined low level, the internal light is illuminated thus causing the lens 16 effectively to glow.

In order to retain the light 10 in position after it has been in place, the housing 14 is attached to a stake 12 which is generally cruciform in shape and formed symmetrically with a plurality of sawtooth shaped members 22, 24, 26, and 28 disposed within each of the four cavities defined by the general cruciform as illustrated at 30. It should be noted that each of the sawtooth members 22 through 28 is formed such that the upper portion thereof provides a substantially flat ledge 32, 34, 36, and 38 respectively which is substantially normal to the adjacent arms 40 and 42 forming the stake 12. The body of the stake then tapers longitudinally inwardly toward the arm 40 for the sawtooth members 22 through 28 as shown in FIG. 1. It will be recognized that such configuration of the sawtooth members contained within each of the four quadrants formed by the general cruciform shape will permit easy insertion of the stake into the earth but difficult removal therefrom since the flat platforms or ledges would tend to catch the earth, thus requiring movement of a large amount of the earth upon attempted removal of the stake from the earth. The housing 14 is secured to the stake in such a manner that once it is in place, it is locked to the stake and cannot easily be removed therefrom without destruction of the housing or the stake. Thus once in place, the marking light is relatively secure.

Figure 2:
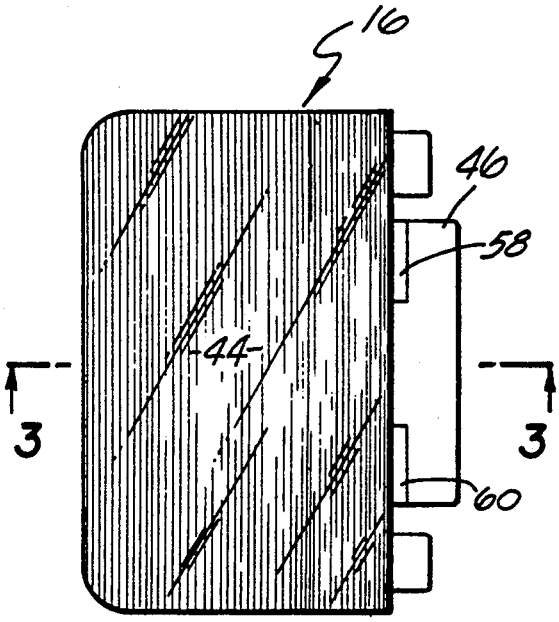
FIG. 2 is a top plan view of the lens of the marking light illustrated in FIG. 1.
Figure 3:
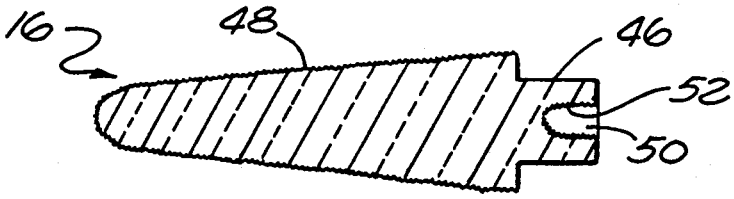
FIG. 3 is a cross sectional view of the lens of FIG. 2 taken about the lines 3—3 thereof.
Figure 4:
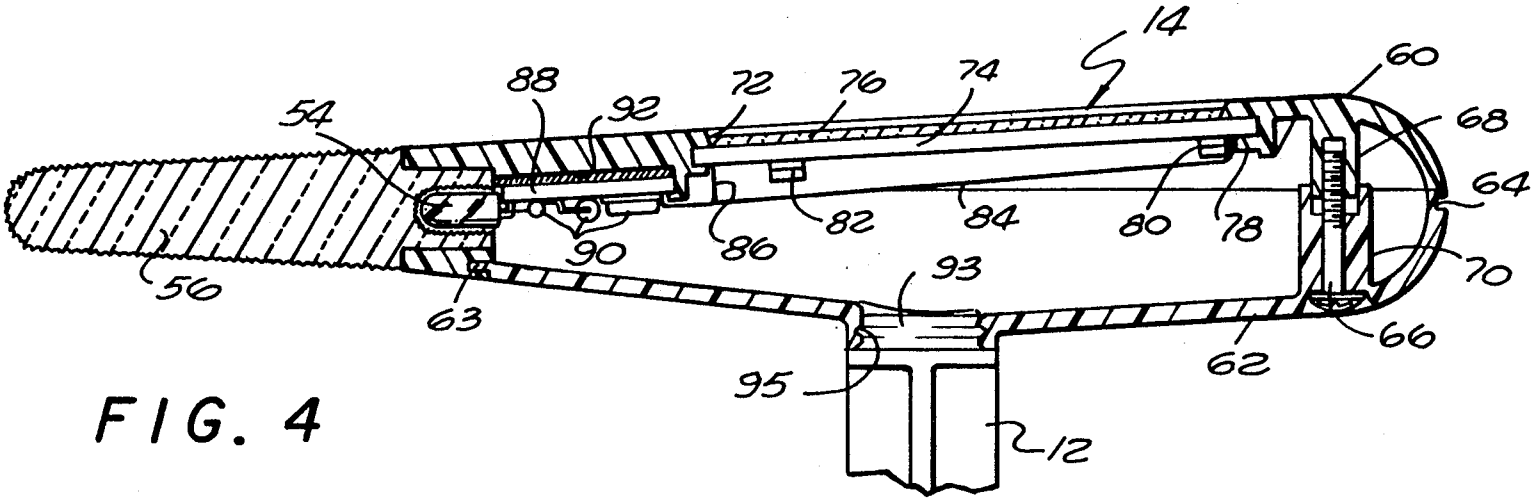
FIG. 4 is a cross sectional view of the marking light structure without the supporting stake taken about the lines 4—4 of FIG. 1.

The lens 16 is shown in greater detail in FIGS. 2 and 3 to which reference is hereby made. The lens is a molded plastic member having a first portion 44 which extends exteriorly of the housing 14 and a second portion 46 which is contained interiorly of the housing 14 as is illustrated more clearly in FIG. 4. The lens portion 44 extending exteriorly of the housing 14 includes a first surface 48 which is textured. The portion 46 of the lens extending interiorly of the housing defines a blind bore 50 which includes a surface 52 which is also textured. The bore 50 receives the source of illumination 54 in a closely coupled manner. When the source of illumination 54 is illuminated, as will be described more fully hereinbelow, the light emanating therefrom is diffused and enters the interior 56 of the lens 16. The lens 16 is preferably a clear molded plastic such as a polycarbonate so that light may travel easily through the interior thereof. As the light travels through the interior 56 of the lens 16 and attempts to pass through the exterior surface thereof, it is trapped by the textured surface 48 causing the light to be reflected interiorly of the lens. The light thus is caused to be reflected and retained internally of the lens before passing outwardly thereof at the surface 48. Such internal reflection of the light caused by both the surfaces 52 and 48 causes the lens 16 to appear to glow even though a relatively small light source 54 may be utilized.

The lens 16 is provided with a pair of notches or recesses 58-60 on each side of the portion 46 which extends internally into the housing 14. The notches 58–60 are provided to lock the lens in place as by a snap fit when the lens is inserted into the housing 14.

The housing 14 includes upper and lower members 60–62 with the lower member interlockingly fitting into the upper member 60 as shown at 63 and 64. The lower member is then retained in place by a fastening device such as a screw 66 or the like which fits into mating standards 68–70 as is well known. An opening 72 is provided in the upper surface within which is received a plurality of photovoltaic cells protected at their upper surface by a clear plastic plate or cover 76 or the like held in position within the opening 72 of the housing 14. The photovoltaic cells 74 are secured in place by appropriate fingers or the like as shown at 78, 80 and 82 around three sides of the cell 74 so that it may be slid into place prior to positioning of the lower portion 62 of the cover 14.

Appropriate electrical wiring as shown at 84 and 86 is connected between the photovoltaic module 74 and a circuit board 88 which also supports the source of illumination 54 which may be any relatively low voltage source of illumination including a high intensity light emitting diode (LED). Whatever the source of illumination, one of the significant features of the present invention is the close coupling of the source of illumination to the lens 16 by means of inserting the source of illumination into the blind bore 50 as above described.

The circuit board 88 contains appropriate electrical components and is shown generally at 90 and is secured in place for example as by a layer of adhesive 92 or the like within the housing 14. The lower portion 62 of the housing 14 defines an appropriate opening 94 for receiving the upper portion of the stake 12 and includes appropriate notches and/or recesses as illustrated generally at 96 for receiving protrusions at the end of the stake for locking the same in position within the opening 94.

Figure 5:
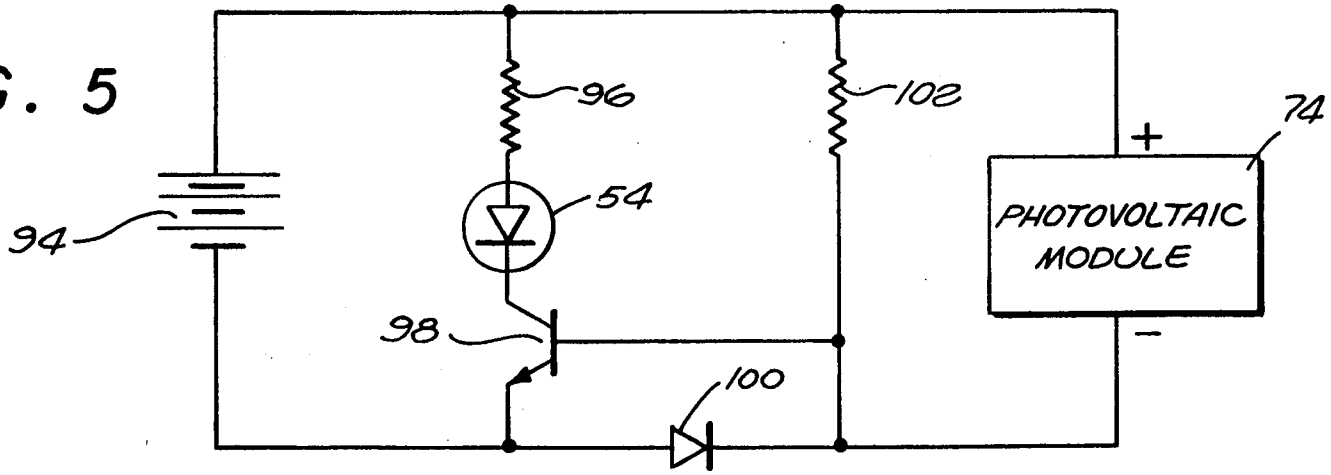
FIG. 5 is a schematic diagram of the electrical circuit of the marking light constructed in accordance with principals of the present invention.

By reference now more particularly to FIG. 5, the electrical interconnection of the source of illumination with the photovoltaic cell and a battery along with the appropriate control circuit is illustrated. As is therein shown, the photovoltaic cell 74 is interconnected to a battery 94. The source of illumination 54 in the form of a high intensity LED is connected by a current limiting resistor 96 and a transistor 98 across the battery 94 and the photovoltaic cell 74. Connected between the negative terminals of the battery 94 and the photovoltaic cell 74 is a current steering diode 100. An additional resistor 102 is connected across the photovoltaic cell 74. The transistor 98 is a N-P-N transistor and functions as a switch to automatically connect the battery 94 to the light source 54 under certain predetermined conditions. The current steering diode 100 functions as a switch control means to cause the transistor 98 to conduct or not conduct thus interconnecting the light source 54 with the battery, or alternatively, opening the circuit to prevent such from occurring. As is well known to those skilled in the art, the photovoltaic cell 74, when generating electrical power as a result of some light striking the same, is used to charge the battery 94 and during such period of time, there is no need for the marking light to function. Thus the light source 54 is disconnected from the power source during such time whether it be the photovoltaic cell 74 or the battery 94. However, when the voltage generated by the photovoltaic cell 74 drops below a predetermined level as established by the level of the ambient light, then the power source consisting of the battery 94 is automatically connected so as to illuminate the light source 54.

The current steering diode 100 functions as the control device to cause the transistor 98 to conduct or not conduct depending upon the relative levels of voltage between the photovoltaic cell 74 and the battery 94. When the ambient light striking the photovoltaic cell 74 is such that the output of voltage generated by it is greater than the voltage of the battery 94, the steering diode 100 will be forward biased causing current to flow from the positive terminal of the photovoltaic cell through the battery 94 positive to negative, thus charging the battery 94. At the same point in time, the voltage drop across the diode 100 will be such as to reverse bias the emitter base diode of the transistor 98, thus causing it to appear as an open circuit across the battery 94 and the photovoltaic cell 74. The resistor 102 has an impedance which is substantially higher than that of the battery 94 and the diode 100, thus causing little or no current flow therethrough.

When, however, the ambient light falling on the photovoltaic cell falls below a predetermined level such that the output voltage from the photovoltaic cell 74 is substantially less than that of the battery 94, the diode 100 becomes reverse biased and then appears as an open circuit precluding flow of current from the photovoltaic cell or the battery toward the other. When such occurs, a positive voltage is applied through the resistor 102 to the base of the transistor 98. Since the emitter thereof is connected to the negative terminal of the battery, the transistor 98 is now caused to commence to conduct thereby completing the circuit through the light source 54 across the battery 94. When such occurs, the light source 54 will illuminate thus causing the lens 16 to appear to glow as above described. It will be recognized by those skilled in the art that as the ambient light increases above the predetermined level or falls below the predetermined level, the electrical power is provided to automatically charge the battery 94 or illuminate the light source 54 respectively.

It has thus been disclosed a self-contained photovoltaic powered marking light which may be utilized to delineate predetermined areas without utilization of a public utility source of electrical power or the like.

What is claimed is:

1. In a self-contained solar powered lamp having a low voltage light source; a rechargeable electrical power source; and a plurality of interconnected photovoltaic cells; a circuit for controlling application of power to the lamp comprising:

switching circuitry coupled to said photovoltaic cells, said electrical power source, and said light source for automatically supplying charging power from said photovoltaic cells to said rechargeable electrical power source, said circuitry blocking power to said light source when the voltage of said photovoltaic cells exceeds the voltage of said electrical power source and automatically supplying illuminating power from said electrical power source to said light source when the voltage of said photovoltaic cells is less than the voltage of said electrical power source.

2. The circuit as defined in claim 1 wherein:

said switching circuitry comprises a switch connected between said light source, said photovoltaic cells and said electrical power source, so that said switch is open during the time the voltage of said photovoltaic cells exceeds the voltage of said electrical power source and closed when the voltage of said electrical power source exceeds the voltage of said photovoltaic cells, and control circuitry for opening and closing said switch.

3. The circuit as defined in claim 2 wherein:

said switch is a transistor; and said control circuitry comprises a single diode connected between like polarity terminals of said photovoltaic cells and said electrical power source.

4. A self-contained light comprising:

a low voltage light source;

a self-contained photovoltaic electrical power source including photovoltaic means and battery means coupled to said light source;

circuitry coupled to said photovoltaic means, said battery means and said light source for automatically supplying charging power from said photovoltaic means to said battery means and blocking power to said light source when ambient light is above a predetermined level such that the voltage of said photovoltaic means exceeds the voltage of said battery means, and for automatically supplying illuminating power from said battery means to said light source when said ambient light is below said predetermined level such that the voltage of said photovoltaic means is less than the voltage of said battery means; and a lens coupled to said light source for transmitting light emanating from said light source.

5. A self-contained light as defined in claim 4 wherein said circuitry includes a switch connected between said battery means and said light source and switch control means connected to said switch for automatically opening said switch when the voltage output of said photovoltaic means exceeds the voltage of said battery means and for automatically closing said switch when the voltage output of said photovoltaic means falls substantially below the voltage of said battery means.

6. A self-contained light as defined in claim 5 wherein said light source is a high intensity light emitting diode.

7. A self-contained light as defined in claim 5 wherein said switch is a single transistor.

8. A self-contained light as defined in claim 7 wherein said switch control means is a diode connected between like polarity terminals of said battery and said photovoltaic means and across the base-emitter of said transistor.

* * * * *